US008523533B1

(12) United States Patent
Best

(10) Patent No.: US 8,523,533 B1
(45) Date of Patent: Sep. 3, 2013

(54) CONSTANT HORSEPOWER REGENERATIVE ASSIST FOR A HYDRAULIC ROD PUMPING UNIT

(76) Inventor: Larry D. Best, Springtown, TX (US)

( * ) Notice: Subject to any disclaimer, the term of this patent is extended or adjusted under 35 U.S.C. 154(b) by 0 days.

(21) Appl. No.: 13/608,132

(22) Filed: Sep. 10, 2012

(51) Int. Cl.
*F04B 49/00* (2006.01)

(52) U.S. Cl.
USPC ..... 417/46; 417/904

(58) Field of Classification Search
USPC ..... 417/46, 375, 398, 415, 555.1, 904; 166/68.5, 72; 60/372
See application file for complete search history.

(56) References Cited

U.S. PATENT DOCUMENTS 2,612,142 A * 9/1952 Smith ..... 91/347
2,699,154 A * 1/1955 Smith ..... 91/311
2,770,197 A * 11/1956 Deitrickson ..... 417/46
3,212,406 A * 10/1965 McDuffie ..... 91/165
4,480,685 A * 11/1984 Gilbertson ..... 166/68.5
4,646,517 A * 3/1987 Wright ..... 60/371
4,691,511 A * 9/1987 Dollison ..... 60/414
8,087,904 B2 1/2012 Best

* cited by examiner

*Primary Examiner* — Peter J Bertheaud
(74) *Attorney, Agent, or Firm* — Mark W Handley

(57) ABSTRACT

A hydraulic rod pumping unit (12) has a constant horsepower regenerative assist featuring downstroke energy recovery. The pumping unit (12) has a hydraulic ram (26) connected to a ram pump (18). The drive shaft (40) of the ram pump (18) is coupled to the drive shaft (38) of an accumulator pump (20) and to a rotor of a drive motor (16). A hydraulic accumulator (24) is connected to the output of the accumulator pump (20). The ram pump (18) and the accumulator pump (20) are preferably variable displacement piston pumps which are controlled by a microprocessor based controller (44), such that during the downstroke of the hydraulic ram (26) the ram pump (18) operates as an hydraulic motor powering the accumulator pump (20) and during the up stroke of the hydraulic ram (26) the accumulator pump (20) operates as a hydraulic motor to provide assist to the ram pump (18).

20 Claims, 2 Drawing Sheets

FIG. 1
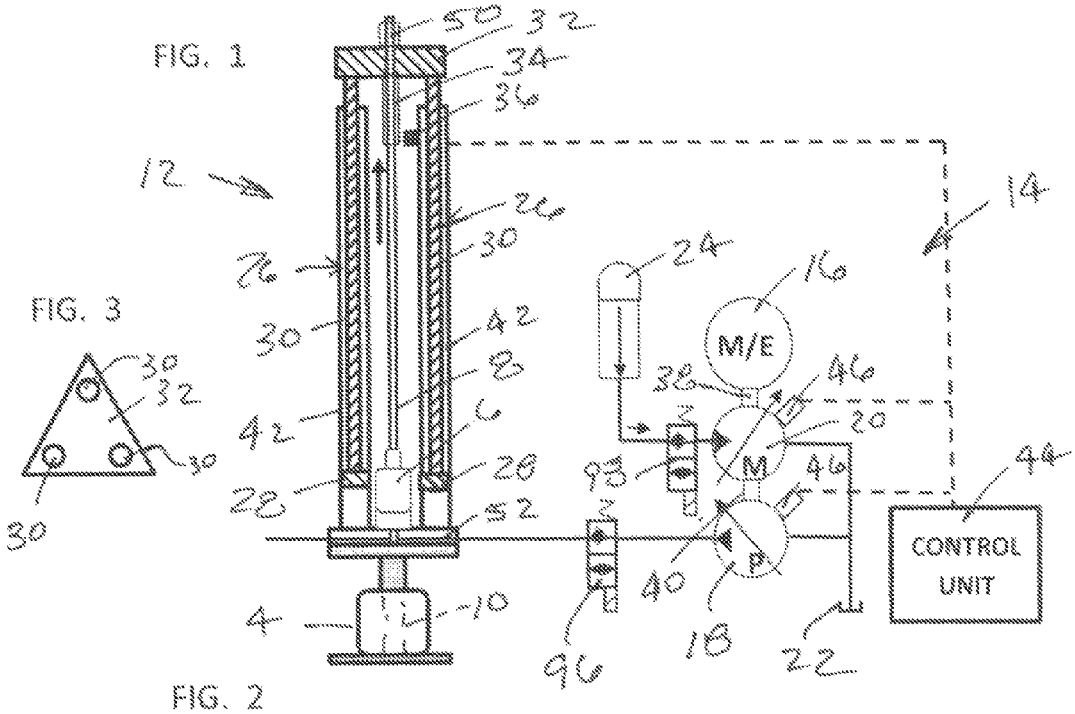
FIG. 3
FIG. 2
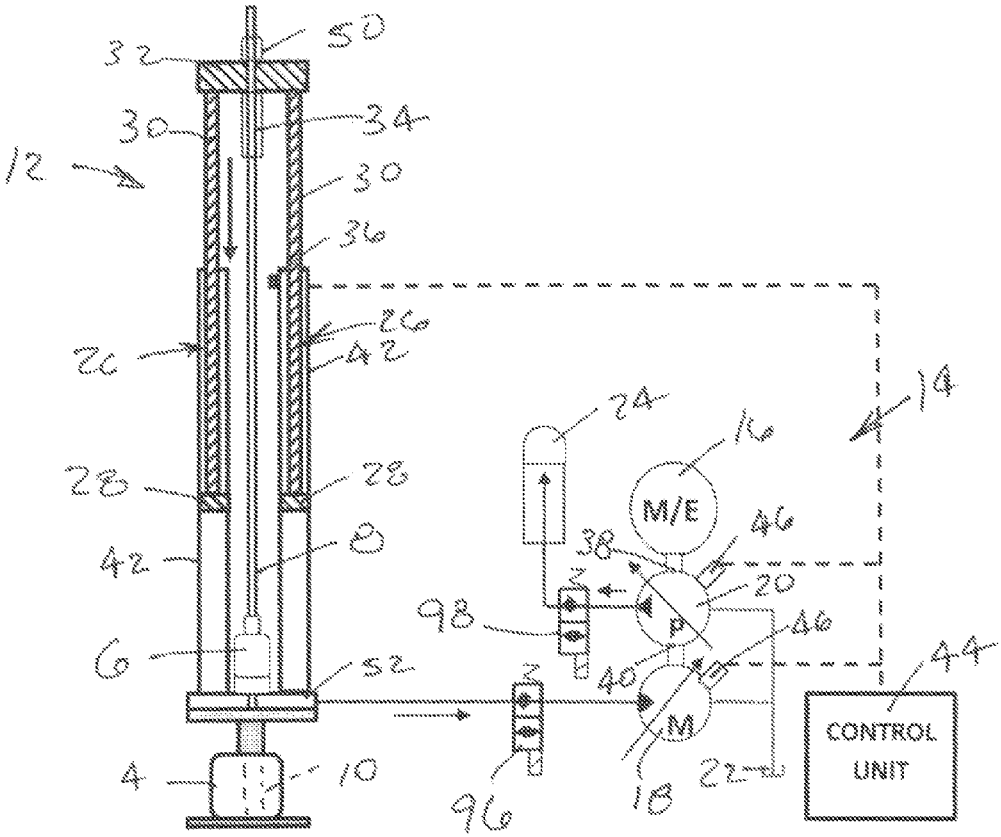

CONSTANT HORSEPOWER REGENERATIVE ASSIST FOR A HYDRAULIC ROD PUMPING UNIT

TECHNICAL FIELD OF THE INVENTION

The present invention relates in general to pump units for oil wells, and in particular to a hydraulic pumping unit having a regenerative assist.

BACKGROUND OF THE INVENTION

Hydraulic pumping units have been provided for pumping fluids from subterranean wells, such as oil wells. The pumping units have hydraulic power units and controls for the hydraulic power units. The hydraulic power units have an electric motor or a gas motor which powers a positive displacement pump to force hydraulic fluid into a hydraulic ram. The ram is stroked to an extended position to lift sucker rods within a well and provide a pump stroke. The ram lifts the weight of the sucker rods and the weight of the well fluids being lifted with the sucker rods. When the ram reaches the top of the pump stroke, the hydraulic fluid is released from within the ram at a controlled rate to lower the weight of the sucker rods into a downward position, ready for a subsequent pump stroke. The hydraulic fluid is released from the ram and returns to a fluid reservoir. Potential energy of the weight of the lifted sucker rods is released and not recovered when the hydraulic fluid is released from within the ram and returns directly to the fluid reservoir without being used to perform work.

Hydraulic assists are commonly used in hydraulic well pumping units to assist in supporting the weight of the sucker rods. Hydraulic accumulators are used in conjunction with one or more secondary hydraulic rams which are connected to primary hydraulic rams to provide an upward support force. The hydraulic accumulators are provided by containers having hydraulic fluids and nitrogen pre-charges ranging from one to several thousand pounds per square inch. Although the volumes of the containers are constant, the volume of the nitrogen charge region of the containers will vary depending upon the position of the ram piston rod during a stroke. At the top of an up-stroke of the ram, the nitrogen charge region of a connected accumulator will have the largest volume, with the nitrogen having expanded to push hydraulic fluid from within the accumulator and into the secondary rams. At the bottom of a down-stroke the nitrogen charge region will be at its smallest volume, compressed by hydraulic fluid being pushed from the secondary rams back into the accumulator. According to Boyle's Law, the pressure in the charge region is proportional to the inverse of the volume of the charge region, and thus the pressure will increase during the up-stroke and decrease during the up stroke. This results in variations in the amount of sucker rod weight supported by the secondary hydraulic rams during each stroke of the ram pumping unit.

Drive motors for hydraulic pumps are sized to provide sufficient power for operating at maximum loads. Thus, motors for powering hydraulic pumps for prior art accumulator assisted pumping units are sized for lifting the sucker rod loads when the minimum load lifting assist is provided by the accumulator and the secondary ram. Larger variations in accumulator pressure and volume between the top of the up-stroke and the bottom of the down-stroke have resulted larger motors being required to power the hydraulic pump connected to the primary ram than would be required if the volume and pressure of the nitrogen charge section were subject to smaller variations. Large motors will burn more fuel or use more electricity than smaller motors. Several prior art accumulator containers may be coupled together to increase the volume of the nitrogen charge region in attempts to reduce variations in pressure between top of the up-stroke and the bottom of the down-stroke. This has resulted in a large number of accumulator containers being present at well heads, also resulting in increasing the number of hydraulic connections which may be subject to failure.

SUMMARY OF THE INVENTION

An assist for a hydraulic rod pumping unit is disclosed which does not make use of secondary hydraulic rams, and which provides both downstroke energy recovery and a constant horsepower assist using smaller accumulator sizes than used in the prior art. Two variable displacement, positive displacement pumps are coupled to a single drive motor. The first pump is connected between a hydraulic fluid reservoir and a hydraulic ram for the pumping unit. The accumulator pump is connected between the hydraulic fluid reservoir and an accumulator chamber, which preferably has a nitrogen pre-charge region. The ram and accumulator pumps are connected to a control unit which automatically controls the displacement of each of the pumps and selectively determines whether each of the pumps are operable as a hydraulic motor or a hydraulic pump. Preferably, the ram and accumulator pumps are variable displacement, open loop piston, hydraulic pumps which are modified for operating in a reverse flow direction, such that the hydraulic fluid may pass from the hydraulic ram, back into the pump discharge port, through the pump, through the pump suction port and into a fluid reservoir with the drive shaft for both of the hydraulic pumps and the rotor, or drive shaft, of the drive motor turning in the same angular direction as that for pumping the hydraulic fluid into the ram. Reversing the flow direction of the hydraulic fluid through the pumps selectively uses respective ones of the pumps as hydraulic motors which provides power for turning the other pump.

A control unit determines actuation of the pumps for either pumping fluids or providing a hydraulic motor for turning the other pump, in combination with the power output by the drive motor. The control unit includes a microprocessor which controls hydraulic motor displacement for each pump with feedback from pump/motor displacement, pressure transducer and speed sensor. During the up stroke of the well head pumping unit, the accumulator pump is operated as a motor driven by the charge on the accumulator and the control unit increases motor displacement proportional to the pressure decrease in the accumulator charge to maintain a constant output torque or HP to assist the pump even if drive shaft speeds change During the down stroke of the well head pumping unit, the accumulator motor is operated as a pump that charges the accumulator and the hydraulic ram pump is operated as a motor driven by the down stroke rod load that drives the accumulator pump with displacement, pressure and speed feedback that decreases pump displacement proportional to the pressure increase to maintain a constant HP during recharging of the accumulator. This results in recovery of the potential energy stored by lifting the weight of the sucker rod assembly during the ram up stroke being recovered by passing the hydraulic fluid from the ram through the ram pump in the reverse flow direction, and actuating the ram pump to act as a motor and assist the drive motor in driving the accumulator pump. The power assist provided by using the accumulator pump as a motor results in reducing the size requirements for the drive motor to power the ram pump to drive the hydraulic ram for moving the weight of the sucker rods and associated well fluids.

DESCRIPTION OF THE DRAWINGS

For a more complete understanding of the present invention and the advantages thereof, reference is now made to the following description taken in conjunction with the accompanying Drawings in which FIGS. 1 through 3 show various aspects for a hydraulic rod pumping unit having a constant horsepower regenerative assist, as set forth below:

FIG. 1 is a schematic diagram depicting a side elevation view of the hydraulic rod pumping unit during an up stroke;

FIG. 2 is a schematic diagram depicting a side elevation view of the hydraulic rod pumping unit during a downstroke;

FIG. 3 is a partial top view of the hydraulic rod pumping unit showing three hydraulic rams used in the unit.

DETAILED DESCRIPTION OF THE INVENTION

Figure 4:
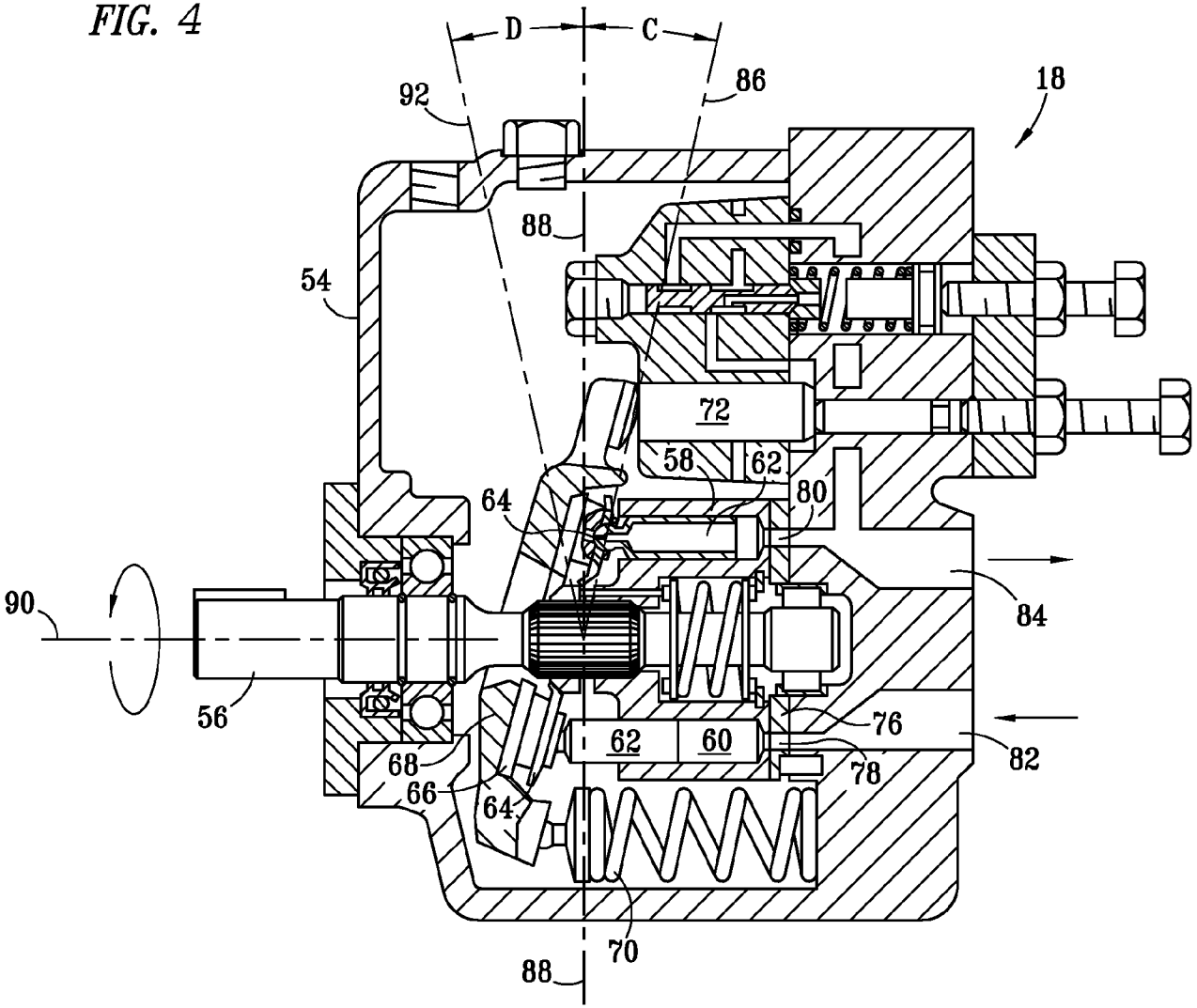
FIG. 4 is a longitudinal section view of a variable volume piston pump which is operable in both conventional flow and reverse flow directions with the motor shaft continuously moving in the direction for pumping fluid.

FIGS. 1 and 2 are a schematic diagram depicting a side elevation view of a hydraulic rod pumping unit 12 having a constant horsepower regenerative assist. FIG. 1 shows the pumping unit in an up stroke, and FIG. 2 shows the pumping unit in a down stroke. The pumping unit 12 is preferably a long stroke type pumping unit with heavy lift capabilities for pumping fluids from a well. The ram pumping unit 12 preferably has three single acting hydraulic rams 26, a sucker rod assembly 10, and a hydraulic power unit 14. FIG. 3 is a partial top view of the hydraulic rod pumping unit 12 and shows the three hydraulic rams 26 connected together by a plate 32 to which the piston rods 30 are rigidly connected. A polished rod 8 is suspended from the plate 32 by a polished rod clamp 50, and extends through a stuffing box 6 for passing into a well head 4 and connecting to sucker rods 10 of a downhole well pump for lifting fluids from the well.

Each of the hydraulic rams 26 has a guide 28 and a rod 30 which reciprocate within a cylinder 42. Preferably, the rod 30 provides the piston element within each of the hydraulic rams 26, and the guide 28 does not seal but rather centers the end of the rod 30 and provides bearings within the cylinder 42. The only hydraulic connection between the power unit 14 and the ram 26 is a single high pressure hose 48 which connects to a manifold plate 52, which ports fluid between each of the rams 26 and the hose 48. The hydraulic power unit 14 includes a drive motor 16, two variable volume piston pumps 18 and 20, a fluid reservoir 22, a hydraulic accumulator 24, and a control unit 44. The drive motor 16 may be an electric motor, or a diesel, gasoline or natural gas powered engine. The control unit 44 preferably includes a motor control center and a microprocessor based variable speed pump down system. The hydraulic accumulator 24 preferably is of a conventional type having a nitrogen charge region which varies in volume with pressure. The pump down system monitors the polished rod load and position to make appropriate speed adjustments to optimize production from the well while keeping operational costs at a minimum. The ram pump 18 and the accumulator pump 20 preferably each have a pump control unit 46 mounted directly to respective ones of the associated pumps housings. Valves 96 and 98 are provided for preventing hydraulic fluid from draining from the hydraulic rams 26 and the accumulator 24, respectively, when the drive motor 16 is not running.

The control unit 44 and the two pump control units 46 are provided for controlling operation of the pump 18 and the pump 20. The control unit 44 is preferably a microprocessor-based controller which is provided sensor inputs for calculating the stroke position of the piston rod 30 of the ram 26, and the polished rod load. The polished rod load is calculated from the measured hydraulic pressure and the weight of the sucker rods 10 at the well head 4. The control unit 44 will feed control signals to the pump control units 46, to vary the flow rate through respective ones of the pump 18 and the pump 20. The pump control units 46 are integral pump controllers which are preferably provided by microprocessor-based units that are mounted directly to respective ones of the pumps 18 and 20, such as such a Model 04EH Proportional Electrohydraulic Pressure and Flow Control available from Yuken Kogyo Co., Ltd. of Kanagawa, Japan, the manufacturer of the pumps 18 and 20 of the preferred embodiment. The Yuken Model 04EH pump controller includes a swash plate angle sensor and a pump pressure sensor, and provides control of each of the swash plate angles C and D (shown in FIG. 3) to separately control the pressure outputs and the flow rates of the hydraulic fluid through respective ones of the pumps 18 and 20.

FIG. 4 is a longitudinal section view of the variable volume piston pump used for both the pump 18 and the pump 20. The pump is operable in both a conventional flow direction mode and a reverse flow direction mode, with a drive shaft 56 of the pump 18 and the rotor of the drive motor 16 continuously turning in the same angular direction for both flow directions. The pump 18 has a pump housing 54 within which is the drive shaft 56 is rotatably mounted. The pump drive shaft 56 is connected to the rotor of the drive motor 16 (shown in FIG. 1), in conventional fashion. A cylinder block 58 is mounted to the drive shaft 56, in fixed relation to the drive shaft 54 for rotating with the drive shaft 56. Preferably, a portion of the outer surface of the drive shaft 56 is splined for mating with splines in an interior bore of the cylinder block 58 to secure the drive shaft 56 and the cylinder block 58 in fixed relation. The cylinder block 58 has an inward end and an outward end. The inward end of the cylinder block 58 has a plurality of cylinders 60 formed therein, preferably aligned to extend in parallel, and spaced equal distances around and parallel to a centrally disposed, longitudinal axis 90 of the drive shaft 56. The drive shaft 56 and the cylinder block 58 rotate about the axis 90. Pistons 62 are slidably mounted within respective ones of the cylinders 60, and have outer ends which are disposed outward from the cylinders for engaging retainers 62. The retainers 62 secure the outer ends of the pistons 62 against the surface of a swash plate 66. The outward end of the cylinder block 58 is ported with fluid flow ports for passing hydraulic fluid from within the cylinders 60, through the outward end of the cylinder block 58. A port plate 76 is mounted in fixed relation within the pump housing 54, and engages the outward, ported end of the cylinder block 58. The port plate 76 has a first fluid flow port 78 and a second fluid flow port 80, with the first flow port 78 and the second flow port 80 connected to the pump suction port 82 and the pump discharge port 84. The suction port 82 and the discharge port 84 are defined according to conventional operation of the pumps 18 and 20, in moving hydraulic fluid from the fluid reservoir 22 and into the hydraulic ram 26. The pistons 62, the cylinders 60 and the cylinder block 58 rotate with a pump drive shaft 56, with the outer ends of the pistons 62 engaging the swash plate 66 and the ported end of the cylinder block 58 engaging the port plate 76.

The swash plate 66 is mounted to a yoke or a cradle 68, preferably in fixed relation to the cradle 68, with the swash plate 66 and the cradle 68 pivotally secured within the motor housing 54 for angularly moving about an axis which is perpendicular to the longitudinal axis 90 of the drive shaft 56. A bias piston 70 is mounted in the pump housing 54 to provide a spring member, or bias means, which presses against one side of the cradle 68 and urges the swash plate 66 into position to provide a maximum fluid displacement for the pump 18 when the pump 18 is operated in conventional flow direction mode to pump the hydraulic fluid from the fluid reservoir 22 into the hydraulic ram 26. A control piston 72 is mounted in the pump housing 54 on an opposite side of the pump drive shaft 56 from the bias piston 70 for pushing against the cradle 68 to move the cradle 68 and the swash plate 66 against the biasing force of the bias piston 70, minimizing fluid displacement for the pump 18, when the pump 18 operated in the conventional flow direction mode to pump the hydraulic fluid from the reservoir 22 into the hydraulic ram 26.

The swash plate 66 preferably has a planar face defining a plane 86 through which extends the central longitudinal axis 90 of the pump drive shaft 56. A centerline 88 defines a neutral position for the swash plate plane 86, with the centerline 88 is preferably defined for the pump 18 as being perpendicular to the longitudinal axis 90 of the drive shaft 56. When the swash plate 66 is disposed in the neutral position, the stroke length for the pistons 62 will be zero and the pump 18 will have zero displacement since the pistons 62 are not moving within the cylinder block 58, as the cylinder block 58 is rotating with the drive shaft longitudinal axis 90. When the swash plate 66 is in the zero stroke position, with an angle C between the swash plate plane 86 and the centerline 88 equal to zero, the pump 18 is said to be operating at center and fluid will not be moved. The angle C between the centerline 88 and the plane 80 of the swash plate 66 determines the displacement for the pump 18. Stroking the control piston moves the cradle 68 and the swash plate 66 from the neutral position, in which the plane 86 the swash plate 66 is aligned with the centerline 88, to a position in which the angle C is greater than zero for operating the pump 18 in the conventional flow mode to provide hydraulic fluid to the ram 26. The larger the angle C relative to the centerline 88, the larger the displacement of the pump 18 and the larger the volume of fluid moved by the pump 18 for a given speed and operating conditions.

If the plane 86 of the swash plate 66 is moved across the centerline 88 to an angle D, the pump swash plate 66 is defined herein to have moved across center for operating the pumps 18 and 20 over center as a hydraulic motor in the reverse flow mode. When the swash plate 66 is moved across center, the pumps 18 and 20 will no longer move fluid from the fluid reservoir 22 to respective ones of the hydraulic ram 26 and the accumulator 24, but instead will move the hydraulic fluid in the reverse flow direction, either from the hydraulic ram 26 to the fluid reservoir 22 or from the accumulator 24 to the fluid reservoir 22, for the same angular direction of rotation of the pump drive shafts 38, 40 and the rotor for the drive motor 16 as that for pumping hydraulic fluid into the hydraulic ram 26 or the accumulator 24. With fluid flow through the pump 18 reversed, the pressure of the hydraulic fluid in the hydraulic ram 26 may be released to turn the pump 18 as a hydraulic motor, which applies mechanical power to the drive shafts 38 and 40 connecting between the pumps 18 and 20, and the drive motor 16. Similarly, with fluid flow through the pump 20 reversed, the pressure of the hydraulic fluid in the accumulator may be released to turn the pump 20 as a hydraulic motor, which applies mechanical power to the drive shafts 38 and 40 connecting between the pumps 18 and 20, and the drive motor 16.

A position sensor 36 is provided for sensing the stroke position of the rod 30 within the cylinder 42 of the ram 26. The position sensor 36 is preferably provided by a proximity sensor which detects a switch actuator 34 to detect when the ram 26 is at a known position, such as at the bottom of the downstroke as shown in FIG. 1. The control unit 44 is operable to reset a calculated position to a known reference position which is determined when the sensor 36 detects the ram switch actuator 34. Then, the control unit 44 calculates the position of the piston rod 30 within the cylinder 42 by counting the stroke of pump 18 and angle of swash plate 66 within the pump 18, taking into account the volume of the rod 30 inserted into the cylinder 42 during the up stroke. The piston rod 30 acts as the piston element in each of the hydraulic rams 26, such that the cross-sectional area of the piston rod 30 times the length of the stroke of the rod 30 provides the volume of hydraulic fluid displaced during the stroke length. The angle of the swash plate 66 provides the displacement of the pump 18. The rpm at which the pump 18 is turned is known by either the synchronous speed of an electric motor, if an electric motor is used, which is most often 1800 rpm, or the speed set by the governor for a diesel or gas engine. The calculated stroke position is reset to a reference position near the bottom of the downstroke for the ram 26. From the known angular speed and measured angle of the swash plate 66 for selected time intervals, the controller 44 calculates the total flow of hydraulic fluid through the ram pump 18 from the time the piston rod 30 is a the known reference position as detected by the proximity sensor 36, and then determines the stroke for the piston rod according to the cross-sectional area of the piston rod 30.

During operation of the pumping unit 12, the load or weight of the piston rod 30 and the sucker rods 10 provide potential energy created by being lifted with hydraulic pressure applied to the hydraulic ram 26. The potential energy is recaptured by passing the hydraulic fluid from the ram 26 through the hydraulic pump 18, with the swash plate 66 for the pump 18 disposed over center such that the pump 18 acts as a hydraulic motor to apply power to the pump 20. The control unit 44 positions the swash plate 66 at the angle D from the centerline 88, such that the hydraulic pump 18 recaptures the potential energy stored by the raised sucker rods and powers the pump 20 to store energy in the hydraulic accumulator 24. Then, during the up-stroke the potential energy stored in the accumulator 24 is recaptured by passing the hydraulic fluid from the accumulator 24 through the hydraulic pump 20, with the swash plate 66 for the pump 20 disposed over center such that the pump 20 acts as a hydraulic motor to apply power to the pump 20. The potential energy from the accumulator 23 is applied to the drive shafts 38 and 40 to assist the drive motor 24 in powering the pump 18 to power the ram 26 during the up stroke.

The control unit 44 will analyze data from both pressure on the hydraulic rams 26, and from the calculated the position of the piston rod 30, and will adjust the position of the swash plates 66 in each of the respective pumps 18 and 20 to control the motor displacement. This controls the rate of the oil metered from respective ones of the hydraulic ram 26 and the accumulator 24, thus controlling the down-stroke speed of the ram 26, the pump 18 and the pump 20, which provides a counterbalance for the weight of the sucker rod assembly 10 and may be operated to provide a constant horsepower assist for the drive motor 16. Increasing the displacement increases the speed and decreasing the displacement decreases the speed for the pump 18 and the pump 20, controlling the horsepower assist during an up stroke of the ram 26. During up-stroke of the hydraulic ram 26, the drive motor 16 is operated to move the hydraulic fluid through the pump 18, from the suction port 82 to the discharge port 84 and to the ram 26. The up-stroke speed of the pump 18 is controlled manually or is controlled automatically by a microprocessor-based control unit 44. During the downstroke of the hydraulic ram 26, the pump 18 is stroked over center by moving the swash plate 66 over center, and the hydraulic fluid will flow from the ram 26 into the port 84, through the pump 18 and then out the port 82 and into the reservoir 22, with the pump 18 acting as a hydraulic motor to drive the drive the pump 20, which assisted in providing provided power to the pump 18 for the up-stroke. During the downstroke, the pump 20 will similarly provide power to assist turning the pump 18, with the control unit 44 controlling the angle of the swash plate 66 in the pump 20 and thus rate at which hydraulic fluid is released from the accumulator 24 and power is applied to the drive shafts 38 and 40.

The load on the piston rod 30 at various linear positions as calculated by the controller 44 and detection of the down bottom of stroke position by the proximity sensor 36 are also analyzed by the control unit 44 to automatically provide selected up-stroke and downstroke speeds, and acceleration and deceleration rates within each stroke, for optimum performance in pumping fluids from the well head 4. Should the well begin to pump down, the up-stroke and the downstroke speeds may be adjusted to maintain a constant fluid level within the well. The control unit 44 monitors key data and provides warnings of impending failure, including automatically stopping the pump from operating before a catastrophic failure. The load on the piston rod 30, or the polished rod load for the sucker rods 10 at the well head 4, is preferably determined by measuring hydraulic pressure in the hydraulic rams 26. Sensors may are also preferably provided to allow the control unit 44 to also monitor the speed of the pump drive shafts 38 and 40 and the rotor for the drive motor 16.

The hydraulic pump 18 is a variable displacement pump which is commercially available and requires modification for operation according to the present invention. Pump 18 is commercially available from Yuken Kogyo Co., Ltd. of Kanagawa, Japan, such as the Yuken model A series pumps. Other commercially available pumps may be modified for operating over center, in the reverse flow direction, such as a PD Series pump or a Gold Cup series pumps available from Parker Hannifin HPD, formerly Denison Hydraulics, Inc., of Marysville, Ohio, USA. The Gold cup series pump which uses a hydraulic vane chamber actuator for position a swash plate rather than the control piston of the Yuken model A series pump. The hydraulic vane chamber is preferably powered by a smaller hydraulic control pump connected to the drive shaft of the pumps 18 and 20, rather than being powered by the pumps 18 and 20. Hydraulic fluid is passed on either side of a moveable vane disposed in the vane chamber to move the vane within the chamber, and the vane is mechanically linked to a swash plate to move to swash plate to a desired position. In other embodiments, other type of actuators may be used to control the position of a swash plate relative to the centerline, such as pneumatic controls, electric switching, electric servomotor, and the like. The modifications for the pumps required for enabling operation according to the present invention are directed toward enabling the swash plates for the respective pumps to move over center, that is over the centerline, so that the pump may be operated over center in the review flow direction mode. The commercially available pumps were designed for use without the respective swash plates going over center, that is, they were designed and manufactured for operating in conventional flow direction modes and not for switching during use to operate in the reverse flow direction mode. Typical modifications include shortening sleeves for control pistons and power pistons, and the like. Internal hydraulic speed controls are also typically bypassed to allow operation over center. For the Denison Gold Cup series pumps, pump control manifolds may be changed to use manifolds from other pumps to allow operation of the pump over center. Closed loop pumps and systems may also be used, with such pumps modified to operate over center, in the reverse flow direction.

The hydraulic pumping unit having a constant horsepower regenerative assist provides advantages over the prior art. The pumping unit comprises a single acting hydraulic ram, without secondary rams provided for assist in lifting the sucker rod string. During a downstroke, the pumping unit provides for regeneration and recapture of energy used during the up-stroke. The sucker rod load is used during the downstroke to power a ram pump which a controller has actuated to act as a hydraulic motor and provide useable energy for driving a accumulator pump to charge an accumulator. During the up-stroke the controller actuates the accumulator pump to act as a motor and fluid released from the accumulator provides power for assisting the drive motor in powering the ram pump to raise the ram and lift the sucker rod string. Preferably, controller operates the pumps to determine the rate at which fluids flows from the ram and through the pump, such as by selectively positioning the swash plates for each of the hydraulic pumps to determine a counterbalance flow rate at which hydraulic fluid flows from the ram back into the ram pump and is returned to a reservoir, and the counterbalance flow rate at which the hydraulic fluid flows form the accumulator back into the accumulator pump and is returned to the reservoir. In other embodiments, valving may be utilized to control flow, or a combination of valving and pump controls.

Although the preferred embodiment has been described in detail, it should be understood that various changes, substitutions and alterations can be made therein without departing from the spirit and scope of the invention as defined by the appended claims.

What is claimed is:

1. A hydraulic pumping unit for removing well fluids from a well, comprising:

a drive motor having a rotary shaft for turning in a first angular direction;

a reservoir for a hydraulic fluid;

an accumulator for storing potential energy in response to receiving the hydraulic fluid;

a sucker rod assembly disposed in the well for removing the well fluids from the well;

a ram connected to said sucker rod assembly for moving in an up-stroke from a retracted position to an extended position and moving said sucker rod assembly from a lowered position to a raised position, and moving in a down-stroke from said extended position to said retracted position with said sucker rod assembly moving from said raised position to said lowered position;

a ram pump connected to said rotary drive shaft, said ram pump having a ram pump suction port connected to said reservoir and a ram pump discharge port connected to said ram for during the up-stroke of said ram transferring the hydraulic fluid into said ram and moving said ram from said retracted position to said extended position, and during the down-stroke transferring the hydraulic fluid into said reservoir;

an accumulator pump connected to said rotary drive shaft, said accumulator pump having an accumulator pump suction port connected to said reservoir and an accumulator pump discharge port connected to said hydraulic accumulator for transferring the hydraulic fluid into said hydraulic accumulator and storing potential energy in said hydraulic accumulator during the down-stroke of said ram, and during the up-stroke transferring the hydraulic fluid into said reservoir;

at least one control unit adapted for controlling flow rates of the hydraulic fluid through said ram pump and said accumulator pump, and adapting said ram pump for pumping the hydraulic fluid into said ram during the up-stroke and during the down-stroke passing the hydraulic from said ram into said reservoir and turning said rotary shaft in said first angular direction to power said accumulator pump in response to pressures within the ram provided by the weight of said sucker rod assembly in combination with said drive motor, and adapting said accumulator pump for pumping the hydraulic fluid into said accumulator during the down-stroke and during the up-stroke passing the hydraulic fluid from said accumulator into said reservoir and turning said rotary shaft in said first angular direction to power said accumulator pump in response to pressure within said accumulator in combination with said drive motor.

2. The hydraulic pumping unit according to claim 1, wherein said ram and accumulator pumps each further comprise:

a motor housing;

a drive shaft rotatably mounted in said motor housing;

a cylinder block mounted to said drive shaft for rotating with said drive shaft, said cylinder block having a plurality of cylinders formed therein, and a plurality of flow ports in fluid communication with respective ones of said cylinders;

a plurality of pistons mounted in respective ones of said cylinders formed into said cylinder block, wherein said pistons are moveable within respective ones of said cylinders for pulling fluid into and pushing fluid out of said cylinders through respective ones of said flow ports; and a port plate for engaging said cylinder block and passing the hydraulic fluid from respective ones of said fluid flow ports to a pump suction port and to a pump discharge port corresponding to angular positions of said cylinder block rotating with said drive shaft.

3. The hydraulic pumping unit according to claim 2, wherein each of said ram and accumulator pumps further comprise a swash plate adapted to engage said plurality of pistons and move said pistons within said cylinders in response to said cylinder block rotating with said drive shaft, wherein said swash plate urges said pistons to press the hydraulic fluid from within said cylinder block when respective ones of said pistons are disposed in proximity to said pump suction port, and to draw hydraulic fluid into said cylinder block when respective ones of said pistons are disposed in proximity to said pump suction port.

4. The hydraulic pumping unit according to claim 3, wherein said swash plate is pivotally mounted within said pump housing for angularly moving about an axis to vary lengths of stroke for said pistons within said cylinder block to determine displacements for said pump.

5. The hydraulic pumping unit according to claim 4, wherein said swash plate is angularly movable over a neutral, center line position to operate said pump in a reverse flow direction in which the hydraulic fluid passes through said pump discharge port, into said cylinder block, and then through said pump suction port to power said pump to drive said drive motor.

6. The hydraulic pumping unit according to claim 4, further comprising a control member mounted in said pump housing and adapted for angularly moving said swash plate about said axis.

7. The hydraulic pumping unit according to claim 5, wherein said control member comprises a control piston, and said control piston is actuated by the hydraulic fluid.

8. The hydraulic pumping unit according to claim 5, further comprising a bias member for urging said swash plate into a first angular position respective to said drive shaft; and wherein said neutral, centerline position for said swash plate is a plane of said swash plate for engaging said pistons disposed generally perpendicular to a longitudinal axis of said drive shaft about which said drive shaft rotates.

9. The hydraulic pumping unit according to claim 1, further comprising a positioning system which includes a proximity sensor for determining when said ram is disposed in a selected reference position, a sensor disposed within said ram pump for determining angles at which said swash plate is disposed for determining corresponding displacements for said ram pump, and wherein said swash plate is turned at a known angular speed and said controller is configured for calculating positioning of said ram from the selected reference position and a determined total flow through the ram pump.

10. A hydraulic pumping unit for removing well fluids from a well, comprising:

a drive motor having a rotary shaft for turning in a first angular direction;

a reservoir for a hydraulic fluid;

an accumulator for storing potential energy in response to receiving the hydraulic fluid;

a sucker rod assembly disposed in the well for removing the well fluids from the well;

a ram connected to said sucker rod assembly for moving in an up-stroke from a retracted position to an extended position and moving said sucker rod assembly from a downward position to a raised position, and moving in a down-stroke from said extended position to said retracted position with said sucker rod assembly moving from said raised position to said lowered position;

a ram pump connected to said rotary drive shaft, said ram pump having a ram pump suction port connected to said reservoir and a ram pump discharge port connected to said ram for during the up-stroke of said ram transferring the hydraulic fluid from said reservoir into said ram and moving said ram from said retracted position to said extended position, and during the down-stroke transferring the hydraulic fluid from said ram into said reservoir;

an accumulator pump connected to said rotary drive shaft, said accumulator pump having an accumulator pump suction port connected to said reservoir and an accumulator pump discharge port connected to said hydraulic accumulator for transferring the hydraulic fluid from said reservoir into said accumulator and storing potential energy in said hydraulic accumulator during the down-stroke of said ram, and during the up-stroke transferring the hydraulic fluid from said accumulator into said reservoir;

said ram and said accumulator pumps each having a drive shaft, a cylinder block, a plurality of pistons, a swash plate and a port plate, said drive shaft coupled to said rotary drive shaft, said cylinder block mounted to said first drive shaft for rotating with said first drive shaft and engaging said port plate, said cylinder block adapted for movably receiving a plurality of pistons, with said pistons adapted for being moved by said swash plate to displace the hydraulic fluid within said cylinder block with rotation of said cylinder block and said first drive shaft, and said port plate engaging said cylinder block for passing the hydraulic fluid between a pump suction port and a pump discharge port depending upon angular positions of said cylinder block relative to said port plate;

at least one control unit adapted for controlling flow rates of the hydraulic fluid through said ram pump and said accumulator pump, and adapting said ram pump for pumping the hydraulic fluid into said ram during the up-stroke and during the down-stroke passing the hydraulic from said ram into said reservoir and turning said rotary shaft in said first angular direction to power said accumulator pump in response to pressures within said ram provided by the weight of said sucker rod assembly in combination with said drive motor, and adapting said accumulator pump for pumping the hydraulic fluid into said accumulator during the down-stroke and during the up-stroke passing the hydraulic fluid from said accumulator into said reservoir and turning said rotary shaft in said first angular direction to power said accumulator pump in response to pressure within said accumulator in combination with said drive motor.

11. The hydraulic pumping unit according to claim 10, wherein said swash plate is pivotally mounted within said pump housing for angularly moving about an axis to vary lengths of stroke for said pistons within said cylinder block to determine displacements for said pump.

12. The hydraulic pumping unit according to claim 11, wherein said swash plate is angularly movable over a neutral, center line position to operate said pump in a reverse flow direction in which the hydraulic fluid passes through said pump discharge port, into said cylinder block, and then through said pump suction port to power said pump to drive said drive motor at speeds faster than synchronous speeds.

13. The hydraulic pumping unit according to claim 12, further comprising a control member mounted in said pump housing and adapted for angularly moving said swash plate about said axis.

14. The hydraulic pumping unit according to claim 13, wherein said control member comprises a control piston, and said control piston is actuated by the hydraulic fluid.

15. The hydraulic pumping unit according to claim 14, further comprising a bias member for urging said swash plate into a first angular position respective to said drive shaft; and wherein said neutral, centerline position for said swash plate is a plane of said swash plate for engaging said pistons disposed generally perpendicular to a longitudinal axis of said drive shaft about which said drive shaft rotates.

16. The hydraulic pumping unit according to claim 15, further comprising a positioning system which includes a proximity sensor for determining when said ram is disposed in a selected reference position, a sensor disposed within said ram pump for determining angles at which said swash plate is disposed for determining corresponding displacements for said ram pump, and wherein said swash plate is turned at a known angular speed and said controller is configured for calculating positioning of said ram from the selected reference position and a determined total flow through the ram pump.

17. A method for operating a pumping unit, comprising the steps of:

providing a ram and a sucker rod assembly, wherein the sucker rod assembly and the ram are located at a well head and configured for lifting well fluids from within the well, further providing a control unit, a drive motor, a ram pump, an accumulator pump, a reservoir for a hydraulic fluid, and an accumulator for receiving the hydraulic fluid and storing potential energy in response thereto, wherein the control unit, the drive motor, the reservoir, the ram pump, the accumulator pump and the accumulator are configured for moving the hydraulic fluid between the reservoir and the hydraulic ram for lifting and lowering the sucker rod assembly, and for moving the hydraulic fluid between the accumulator and the reservoir;

connecting the ram pump, the accumulator pump and the drive motor to a rotary shaft for rotating in one angular direction during both an up-stroke and a downstroke of the ram;

operating the ram pump to move the hydraulic fluid from the reservoir into the ram, lifting the sucker rod assembly, wherein the ram pump is powered by the drive motor in combination with the accumulator pump;

releasing the hydraulic fluid from the ram into the ram pump and to the reservoir, and thereby providing mechanical power in combination with the drive motor for turning the rotary shaft which powers the accumulator pump to move the hydraulic fluid into the accumulator;

controlling the flow of the hydraulic fluid from the ram, through the ram pump and into the reservoir, and the flow of fluid into and out of the accumulator; and wherein potential energy is recovered from the sucker rod assembly when disposed in a lifted position and used to operate the accumulator pump and store at least part of the potential energy for assisting in the up-stroke.

18. The method for operating a pump according to claim 17, wherein:

the step of providing the pump further comprising providing the pump with a cylinder block, a plurality of pistons and a swash plate, wherein the cylinder block rotates with a drive shaft and the pistons engage the swash plate to move within the cylinder block and displace fluid within the cylinder block, wherein the swash plate is moved to determine stroke lengths for the pistons and the displacement of the pump;

the step of controlling the flow of hydraulic fluid from the ram further comprising moving the swash plate to determine a displacement for the pump; and wherein the step of releasing the hydraulic fluid from the ram further comprises moving the swash plate over a neutral, center line position to operate the pump in a reverse flow direction, in which the hydraulic fluid flows from the ram, through the pump discharge port, through the pump, from the pump suction port and into the reservoir.

19. The method for operating a pump according to claim 18, wherein the step of controlling the flow of the hydraulic fluid from the ram further comprises maintaining a load of the sucker rod assembly as the sucker rod assembly is moved to a downward position.

20. The method for operating a pump according to claim 17, further comprising a positioning system which includes a proximity sensor for determining when said ram is disposed in a selected position in a stroke, a sensor in the ram pump for determining the swash plate angle which provides the displacement of the pump, and wherein the pump swash plate is turned at known angular velocity and the controller is configured for calculating positioning of the ram in a stroke relative to the selected position.

* * * * *